US008881791B2

(12) United States Patent
Eason et al.

(10) Patent No.: US 8,881,791 B2
(45) Date of Patent: Nov. 11, 2014

(54) EARTH-BORING TOOLS AND METHODS OF FORMING EARTH-BORING TOOLS

(75) Inventors: Jimmy W. Eason, The Woodlands, TX (US); Michael R. Wells, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 688 days.

(21) Appl. No.: 13/087,204

(22) Filed: Apr. 14, 2011

(65) Prior Publication Data

US 2011/0266068 A1 Nov. 3, 2011

Related U.S. Application Data

(60) Provisional application No. 61/328,878, filed on Apr. 28, 2010.

(51) Int. Cl.

| | |
|---|---|
| ***B22D 19/14*** | (2006.01) |
| ***B22D 13/00*** | (2006.01) |
| ***E21B 10/08*** | (2006.01) |
| ***C22C 26/00*** | (2006.01) |
| ***E21B 10/00*** | (2006.01) |
| ***E21B 10/42*** | (2006.01) |
| ***C22C 32/00*** | (2006.01) |
| ***C22C 38/02*** | (2006.01) |
| ***C22C 19/00*** | (2006.01) |
| ***C22C 1/10*** | (2006.01) |
| *B22F 5/00* | (2006.01) |

(52) U.S. Cl.

CPC ..... *B22D 19/14* (2013.01); *E21B 10/08* (2013.01); *C22C 26/00* (2013.01); *E21B 10/00* (2013.01); *E21B 10/42* (2013.01); *C22C 32/00* (2013.01); *C22C 38/02* (2013.01); *B22F 2005/001* (2013.01); *C22C 19/00* (2013.01); *C22C 1/1036* (2013.01)

USPC ..... 164/97; 164/114

(58) Field of Classification Search

USPC ..... 164/97, 114

See application file for complete search history.

(56) References Cited

U.S. PATENT DOCUMENTS 4,377,196 A * 3/1983 Khandros ..... 164/66.1
5,433,280 A 7/1995 Smith (Continued)

OTHER PUBLICATIONS

International Search Report for International Application No. PCT/US2011/032545 mailed Oct. 25, 2011, 6 pages.

(Continued)

*Primary Examiner* — Kevin P Kerns
(74) *Attorney, Agent, or Firm* — TraskBritt

(57) ABSTRACT

Methods of fabricating earth-boring tools include forming an outer portion of an earth-boring tool from a powder mixture comprising hard particles and matrix particles comprising a metal matrix material, disposing a molten material at least partially within the outer portion of the earth-boring tool, and forming the molten material into another portion of the earth-boring tool. Methods of fabricating a bit body of an earth-boring rotary drill bit include forming an outer portion comprising a plurality of hard particles and a plurality of matrix particles comprising a metal matrix material and casting a molten material at least partially within the outer portion of the bit body to form another portion of the bit body. Earth-boring tools include a body for engaging a subterranean borehole having an outer portion and an inner portion comprising at least one material solidified within a cavity formed within the outer portion.

19 Claims, 7 Drawing Sheets

(56) References Cited

U.S. PATENT DOCUMENTS

| | | | | |
|---|---|---|---|---|
| 5,544,550 | A | 8/1996 | Smith | |
| 5,839,329 | A | 11/1998 | Smith et al. | |
| 5,957,006 | A | 9/1999 | Smith | |
| 6,073,518 | A | 6/2000 | Chow et al. | |
| 6,089,123 | A | 7/2000 | Chow et al. | |
| 6,200,514 | B1 | 3/2001 | Meister | |
| 6,354,362 | B1 | 3/2002 | Smith et al. | |
| 6,581,671 | B2 | 6/2003 | Butcher et al. | |
| 6,655,481 | B2 | 12/2003 | Findley et al. | |
| 7,776,256 | B2 | 8/2010 | Smith et al. | |
| 7,802,495 | B2 | 9/2010 | Oxford et al. | |
| 2005/0211475 | A1 * | 9/2005 | Mirchandani et al. | 175/426 |
| 2007/0102198 | A1 | 5/2007 | Oxford et al. | |
| 2007/0102202 | A1 | 5/2007 | Choe | |
| 2008/0202814 | A1 | 8/2008 | Lyons et al. | |
| 2009/0032310 | A1 | 2/2009 | Stevens et al. | |
| 2009/0301788 | A1 | 12/2009 | Stevens et al. | |
| 2010/0133805 | A1 | 6/2010 | Stevens et al. | |
| 2010/0270086 | A1 | 10/2010 | Matthews, III et al. | |

OTHER PUBLICATIONS

International Written Opinion for International Application No. PCT/US2011/032545 mailed Oct. 25, 2011, 4 pages.

International Preliminary Report on Patentability for International Application No. PCT/US2011/032545 dated Oct. 30, 2012, 4 pages.

* cited by examiner

EARTH-BORING TOOLS AND METHODS OF FORMING EARTH-BORING TOOLS

CROSS-REFERENCE TO RELATED APPLICATION

This application claims the benefit of U.S. Provisional Patent Application Ser. No. 61/328,878, filed Apr. 28, 2010, entitled "Earth-Boring Tools and Methods of Forming Earth-Boring Tools," the disclosure of which is incorporated herein by reference in its entirety.

TECHNICAL FIELD

Embodiments of the present disclosure generally relate to earth-boring drill bits, other tools, and components thereof that may be used to drill subterranean formations and to methods of forming earth-boring tools for use in forming wellbores in subterranean earth formations.

BACKGROUND

Wellbores are formed in subterranean earth formations for many purposes including, for example, oil and gas extraction and geothermal energy extraction. Many tools are used in the formation and completion of wellbores in subterranean earth formations. For example, earth-boring drill bits such as rotary drill bits including, for example, so-called "fixed cutter" drill bits, "roller cone" drill bits, and "impregnated diamond" drill bits are often used to drill a wellbore into an earth formation. Coring or core bits, eccentric bits, and bi-center bits are additional types of rotary drill bits that may be used in the formation and completion of wellbores. Other earth-boring tools may be used to enlarge the diameter of a wellbore previously drilled with a drill bit. Such tools include, for example, so-called "reamers" and "under-reamers." Other tools may be used in the completion of wellbores including, for example, milling tools or "mills," which may be used to form an opening in a casing or liner section that has been provided within a previously drilled wellbore. As used herein, the term "earth-boring tools" means and includes any tool and components thereof that may be used in the formation and completion of a wellbore in an earth formation, including those tools mentioned above.

Earth-boring tools are subjected to extreme forces during use. For example, earth-boring rotary drill bits may be subjected to high longitudinal forces (the so-called "weight-on-bit" (WOB)), as well as to high torques. The materials from which earth-boring tools are fabricated must be capable of withstanding such mechanical forces. Furthermore, earth-boring rotary drill bits may be subjected to abrasion and erosion during use. The term "abrasion" refers to three-body wear mechanism that includes two surfaces of solid materials sliding past one another with solid particulate material therebetween, such as may occur when a surface of a drill bit slides past an adjacent surface of an earth formation with detritus or particulate material therebetween during a drilling operation. The term "erosion" refers to a two-body wear mechanism that occurs when solid particulate material, a fluid, or a fluid carrying solid particulate material impinges on a solid surface, such as may occur when drilling fluid is pumped through and around a drill bit during a drilling operation. The materials from which earth-boring drill bits are fabricated must also be capable of withstanding the abrasive and erosive conditions experienced within the wellbore during a drilling operation.

The bodies of earth-boring tools may be relatively large structures that may have relatively tight dimensional tolerance requirements. As a result, the methods used to fabricate such bodies of earth-boring tools must be capable of producing relatively large structures that meet the relatively tight dimensional tolerance requirements. As the materials from which the earth-boring tools must be fabricated must be resistant to abrasion and erosion, the materials may not be easily machined using conventional turning, milling, and drilling techniques. Therefore, the number of manufacturing techniques that may be used to successfully fabricate such bodies of earth-boring tools is limited. Furthermore, it may be difficult or impossible to form a body of an earth-boring tool from certain composite materials using certain techniques. For example, it may be difficult to fabricate bit bodies for earth-boring rotary drill bits comprising certain compositions of particle-matrix composite materials using conventional infiltration fabrication techniques, in which a bed of hard particles is infiltrated with molten matrix material, which is subsequently allowed to cool and solidify.

As a result of these and other material limitations and manufacturing technique limitations, earth-boring tools may be fabricated using less than optimum materials or they may be fabricated using techniques that are not economically feasible for large scale production.

BRIEF SUMMARY

In some embodiments, the present disclosure includes methods of fabricating an earth-boring tool comprising forming an outer portion of an earth-boring tool from a powder mixture comprising hard particles and matrix particles comprising a metal matrix material, disposing a molten material at least partially within the outer portion of the earth-boring tool, and forming the molten material into another portion of the earth-boring tool.

In additional embodiments, the present disclosure includes methods of fabricating a bit body of an earth-boring rotary drill bit comprising forming an outer portion of a bit body comprising a plurality of hard particles and a plurality of matrix particles comprising a metal matrix material, sintering the outer portion of the bit body to form an at least substantially fully dense outer portion of a bit body of an earth-boring rotary drill bit, and casting a molten material at least partially within the at least substantially fully dense outer portion of the bit body to form another portion of the bit body.

Further embodiments of the present disclosure include earth-boring tools including a body for engaging a subterranean borehole. The body for engaging a subterranean borehole includes an outer portion comprising a first material and an inner portion comprising a second material comprising at least one material solidified within a cavity formed within the outer portion.

Yet further embodiments of the present disclosure include earth-boring tools comprising an outer portion comprising pressed and sintered mixture of hard particles disposed in a metal matrix material and an inner portion comprising a solidified mixture of a eutectic or near eutectic composition comprising tungsten carbide and at least one of cobalt, iron, and nickel.

BRIEF DESCRIPTION OF THE SEVERAL VIEWS OF THE DRAWINGS

While the specification concludes with claims particularly pointing out and distinctly claiming which are regarded as embodiments of the present disclosure, the advantages of embodiments of the present disclosure may be more readily ascertained from the following description of embodiments of the present disclosure when read in conjunction with the accompanying drawings in which:

DETAILED DESCRIPTION

The illustrations presented herein are not meant to be actual views of any particular material, apparatus, system, or method, but are merely idealized representations which are employed to describe the present disclosure. Additionally, elements common between figures may retain the same numerical designation.

As used herein, the terms "distal" and "proximal" are relative terms used to describe portions of earth-boring tools and components thereof with reference to a borehole being drilled. For example, a "distal" portion of an earth-boring tool is the portion in closer relative proximity to the downhole portion of the borehole (e.g., relatively closer to the furthest extent of the borehole and the furthest extent of a drill string extending into the borehole) when the earth-boring tool is disposed in a wellbore extending into a formation during a drilling downhole operation. A "proximal" portion of an earth-boring tool is the portion in closer relative proximity to the uphole portion of the borehole (e.g., relatively more distant from the furthest extent of the borehole and the furthest extent of a drill string extending into the borehole) when the earth-boring tool is disposed in a wellbore extending into the formation during a downhole operation.

Figure 1:
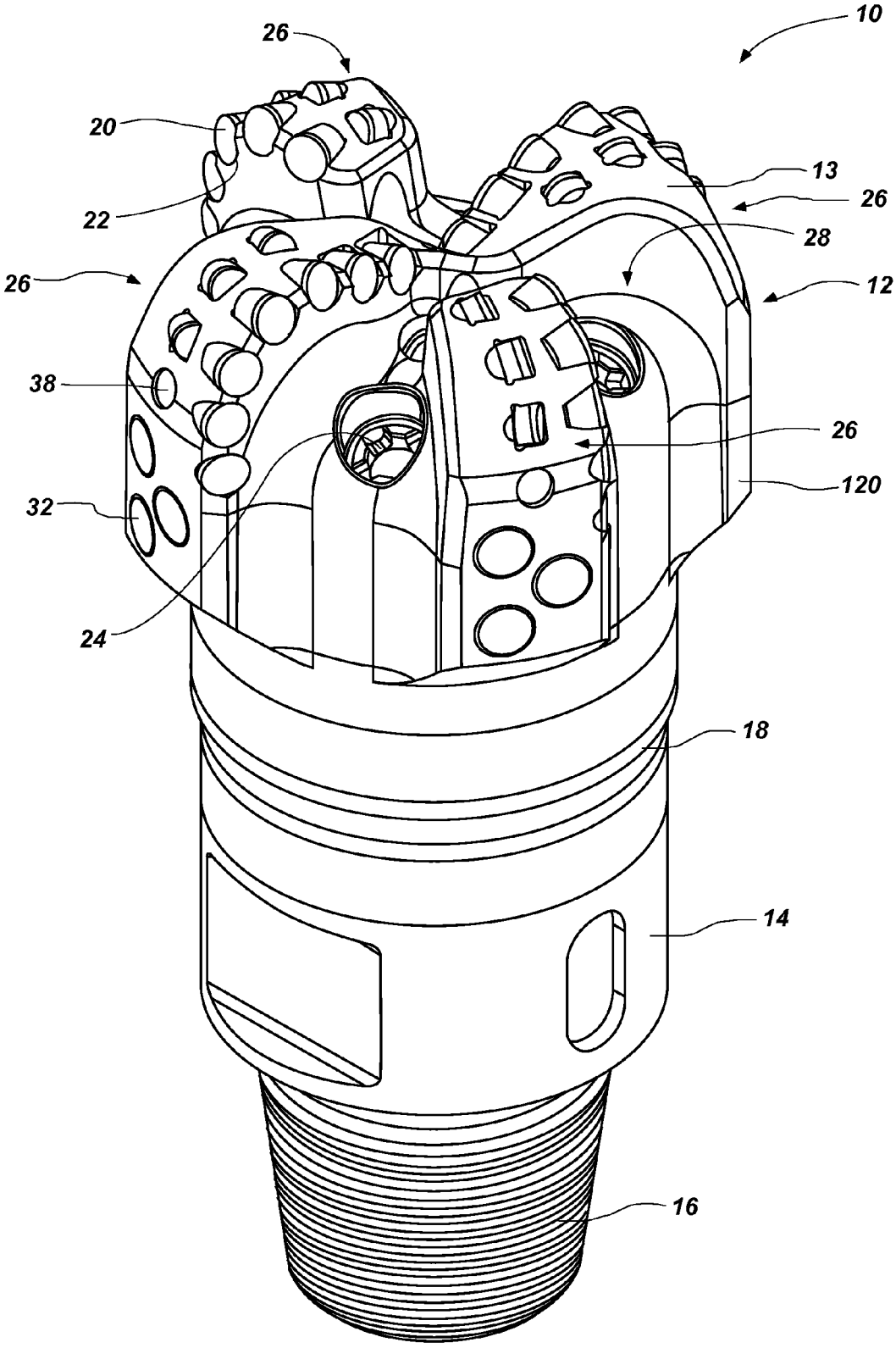
FIG. 1 is a perspective view of an earth-boring rotary drill bit that includes a bit body that may be formed in accordance with embodiments of the present disclosure.
Figure 2:
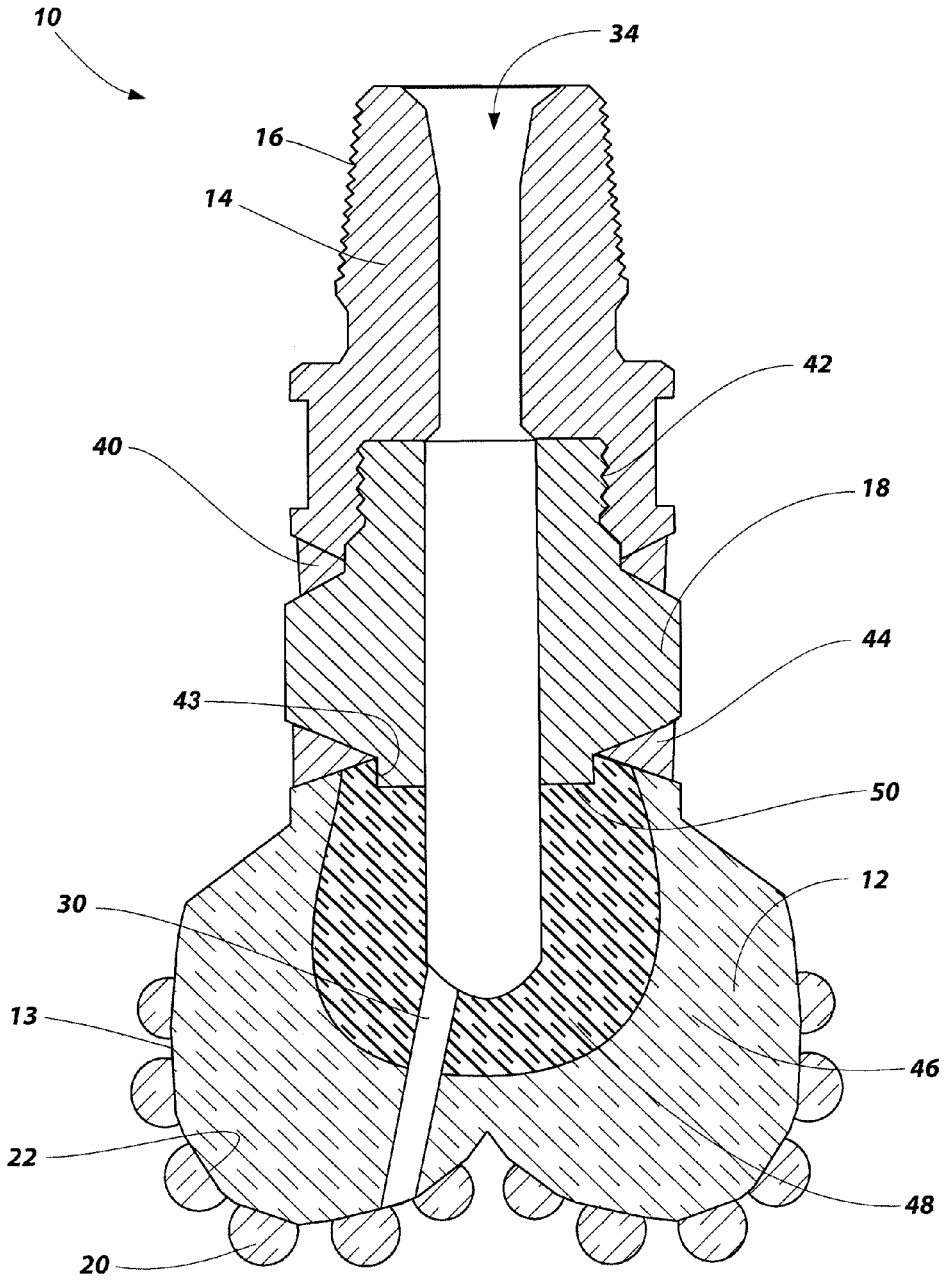
FIG. 2 is a longitudinal cross-sectional view of the earth-boring drill bit shown in FIG. 1.

Embodiments of the present disclosure include methods of formong an earth-boring tool such as, for example, a bit body of an earth-boring rotary drill bit. FIGS. 1 and 2 are a perspective view and longitudinal cross-sectional view, respectively, of an earth-boring rotary drill bit 10. The earth-boring rotary drill bit 10 includes a bit body 12 that may be formed using embodiments of methods of the present disclosure. The bit body 12 may be secured to a shank 14 having a threaded connection portion 16 (e.g., an American Petroleum Institute (API) threaded connection portion) for attaching the drill bit 10 to a drill string (not shown). In some embodiments, such as that shown in FIGS. 1 and 2, the bit body 12 may be secured to the shank 14 using an extension 18. In other embodiments, the bit body 12 may be secured directly to the shank 14. Methods and structures that may be used to secure the bit body 12 to the shank 14 are disclosed in, for example, pending U.S. patent application Ser. No. 11/271,153, filed Nov. 10, 2005, now U.S. pat. No. 7,802,495, issued Sep.28, 2010, U.S. patent application Ser. No. 11/272,439, also filed Nov. 10, 2005, now U.S. pat. No. 7,776,256, issued Aug. 17,2010, pending U.S. patent application Ser. No. 12/181,998, filed Jul. 29, 2008, now U.S. pat. No. 8,381,844, issued Feb. 26, 2013, U.S. patent application Ser. No. 12/429,059, filed Apr. 23, 2009, now U.S. pat. No. 8,381,844, issued Feb. 26,2013, and pending U.S. patent application Ser. No. 12/603,978, filed Oct. 22, 2009, each of which are assigned to the assignee of the present disclosure, and the entire disclosure of each of which is incorporated herein by this reference.

The bit body 12 may include internal fluid passageways 30 that extend between the face 13 of the bit body 12 and a longitudinal bore 34, which extends through the shank 14, the extension 18, and partially through the bit body 12. Nozzle inserts 24 also may be provided at the face 13 of the bit body 12 within the internal fluid passageways 30. The bit body 12 may further include a plurality of blades 26 that are separated by junk slots 28. In some embodiments, the bit body 12 may include gage wear plugs 32 and wear knots 38. A plurality of cutting elements 20 (which may include, for example, PDC cutting elements) may be mounted on the face 13 of the bit body 12 in cutting element pockets 22 that are located along each of the blades 26. The bit body 12 of the earth-boring rotary drill bit 10 shown in FIG. 1 may comprise a particle-matrix composite material that includes hard particles (a discontinuous phase) dispersed within a metallic matrix material (a continuous phase).

Referring to FIG. 2, the extension 18 may be coupled to both the shank 14 and the bit body 12 (e.g., a steel shank and a particle-matrix bit body). For example, the shank 14 may be welded to the extension 18 (e.g., with a weld 40 that extends around at least a portion of the earth-boring rotary drill bit 10). In some embodiments, the shank 14 and the extension 18 may include a complementary threaded interface 42 between the shank 14 and the extension 18 to at least partially attach the shank 14 and the extension 18. The extension 18 may also be attached (e.g., welded, brazed, or a combination of welding and brazing) to the bit body 12 (e.g., with a weld 44 that extends around at least a portion of the earth-boring rotary drill bit 10).

As shown in FIG. 2, the bit body 12 may include multiple regions or layers having differing material compositions. For example, a first region such as, for example, an outer shell 46 having a first material composition and a second region such as, for example, an inner region 48 having a second, different material composition. The outer shell 46 may include the longitudinally lower and laterally outward regions of the bit body 12 (e.g., the crown region of the bit body 12). The outer shell 46 may include the face 13 of the bit body 12, which carries the cutting elements 20, and the blades 26 and junk slots 28 as shown in FIG. 1.

Referring to FIG. 2, the inner region 48 may include the longitudinally upper and laterally inward regions of the bit body 12. The longitudinal bore 34 may extend at least partially through the inner region 48 of the bit body 12. The inner region 48 may include a surface 50 that is configured for attachment of the bit body 12 to the shank 14. By way of example and not limitation, a cavity 43 may be formed on the surface 50 of the inner region 48 that is configured for attachment of the bit body 12 to a shank or an extension 18 (e.g., attached by welding, brazing, or a combination of welding and brazing).

The outer shell 46 of the bit body 12 may be fabricated using powder metallurgical processes such as, for example, press and sintering processes, directed powder spraying, and laser sintering. For example, the outer shell 46 of the bit body 12 may be fabricated using powder compaction and sintering techniques such as, for example, those disclosed in the aforementioned and incorporated by reference U.S. patent application Ser. No. 11/271,153 now U.S. pat. No. 7,802,495, issued Sep. 28, 2010, and U.S. patent application Ser. No. 11/272,439, now U.S. pat. No. 7,776,256, issued Aug. 17,2010. Broadly, the methods comprise injecting a powder mixture into a cavity within a mold to form a green body, and the green body then may be sintered to a desired final density to form a body of an earth-boring tool. Such processes are often referred to in the art as metal injection molding (MIM) or powder injection molding (PIM) processes. The powder mixture may be mechanically injected into the mold cavity using, for example, an injection molding process or a transfer molding process. To form a powder mixture for use in embodiments of methods of the present disclosure, a plurality of hard particles may be mixed with a plurality of matrix particles that comprise a metal matrix material. In some embodiments, an organic material also may be included in the powder mixture. The organic material may comprise a material that acts as a lubricant to aid in particle compaction during a molding process.

The hard particles of the powder mixture may comprise diamond, or may comprise ceramic materials such as carbides, nitrides, oxides, and borides (including boron carbide ($B_4C$)). More specifically, the hard particles may comprise carbides and borides made from elements such as W, Ti, Mo, Nb, V, Hf, Ta, Cr, Zr, Al, and Si. By way of example and not limitation, materials that may be used to form hard particles include tungsten carbide, titanium carbide (TiC), tantalum carbide (TaC), titanium diboride ($TiB_2$), chromium carbide, titanium nitride (TiN), aluminum oxide ($Al_2O_3$), aluminum nitride (AlN), boron nitride (BN), silicon nitride ($Si_3N_4$), and silicon carbide (SiC). Furthermore, combinations of different hard particles may be used to tailor the physical properties and characteristics of the particle-matrix composite material.

The matrix particles of the powder mixture may comprise, for example, cobalt-based, iron-based, nickel-based, aluminum-based, copper-based, magnesium-based, and titanium-based alloys. The matrix material may also be selected from commercially pure elements such as cobalt, aluminum, copper, magnesium, titanium, iron, and nickel. By way of example and not limitation, the matrix material may include carbon steel, alloy steel, stainless steel, tool steel, Hadfield manganese steel, nickel or cobalt superalloy material, and low thermal expansion iron- or nickel-based alloys such as INVAR®. As used herein, the term "superalloy" refers to iron-, nickel-, and cobalt-based alloys having at least 12% chromium by weight. Additional example alloys that may be used as matrix material include austenitic steels, nickel-based superalloys such as INCONEL® 625M or Rene 95, and INVAR® type alloys having a coefficient of thermal expansion that closely matches that of the hard particles used in the particular particle-matrix composite material. More closely matching the coefficient of thermal expansion of matrix material with that of the hard particles offers advantages such as reducing problems associated with residual stresses and thermal fatigue. Another example of a matrix material is a Hadfield austenitic manganese steel (Fe with approximately 12% Mn by weight and 1.1% C by weight).

Figure 3A:
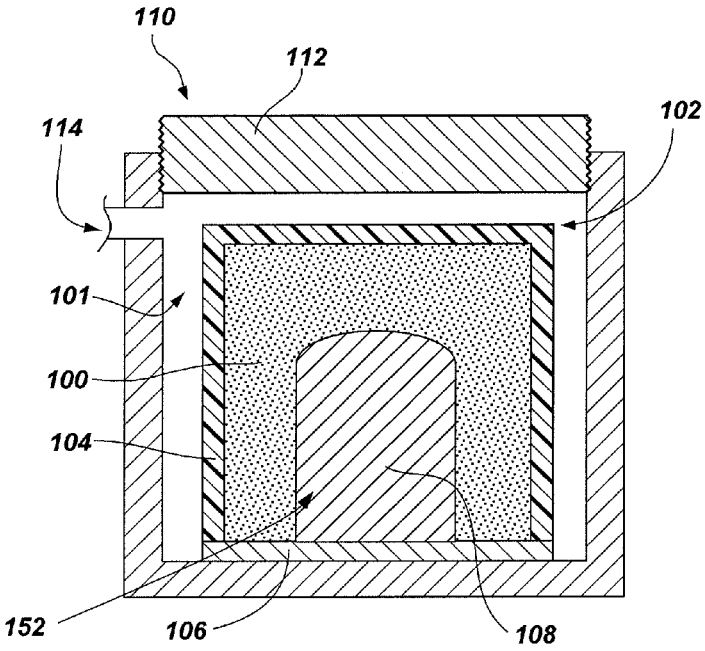
FIGS. 3A through 3D illustrate a method of forming a portion of a bit body of an earth-boring rotary drill bit in accordance with embodiments of the present disclosure.

An exemplary fabrication process using powder compaction and sintering techniques is described briefly below with reference to FIGS. 3A through 3D. Referring to FIG. 3A, a powder mixture 100 (e.g., the powder mixtures described above) may be pressed (e.g., with substantially isostatic pressure) within a mold or container 101. The container 101 may include a fluid-tight deformable member 104 such as, for example, a deformable polymeric bag and a substantially rigid sealing plate 106. Inserts or displacement members 108 may be provided within the container 101 for defining features of a bit body 102 (FIG. 3D) such as, for example, the internal fluid passageways (e.g., the internal fluid passageways 30 and the longitudinal bore 34 of bit body 12 (FIG. 2)) and a cavity 152. The sealing plate 106 may be attached or bonded to the deformable member 104 in such a manner as to provide a fluid-tight seal there between.

The container 101 (with the powder mixture 100 and any desired displacement members 108 contained therein) may be pressurized within a pressure chamber 110. A removable cover 112 may be used to provide access to the interior of the pressure chamber 110. A fluid (which may be substantially incompressible) such as, for example, water, oil, or gas (e.g., air or nitrogen) is pumped into the pressure chamber 110 through an opening 114 at high pressures using a pump (not shown). The high pressure of the fluid causes the walls of the deformable member 104 to deform, and the fluid pressure may be transmitted substantially uniformly to the powder mixture 100.

Figure 3B:
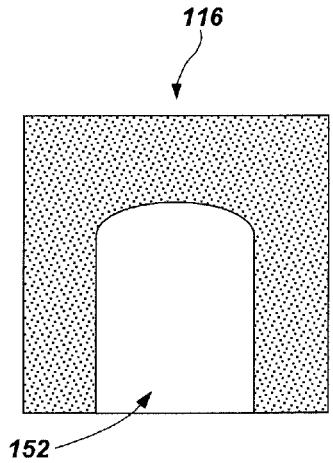

Pressing of the powder mixture 100 may form a green (or unsintered) body 116 shown in FIG. 3B, which can be removed from the pressure chamber 110 and container 101 after pressing.

The green body 116 shown in FIG. 3B may include a plurality of particles held together by interparticle friction forces and an organic mixture material provided in the powder mixture 100 (FIG. 3A). Certain structural features may be machined in the green body 116 using conventional machining techniques including, for example, turning techniques, milling techniques, and drilling techniques. Hand held tools also may be used to manually form or shape features in or on the green body 116. By way of example and not limitation, blades 26 (FIG. 1), and other features may be machined or otherwise foamed in the green body 116 to form a partially shaped green body 118 shown in FIG. 3C.

Figure 3C:
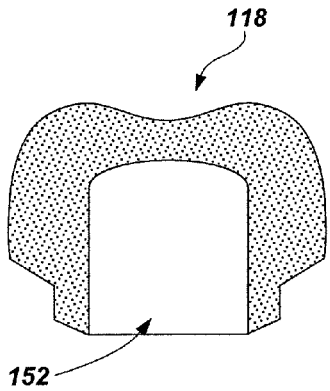
Figure 3D:
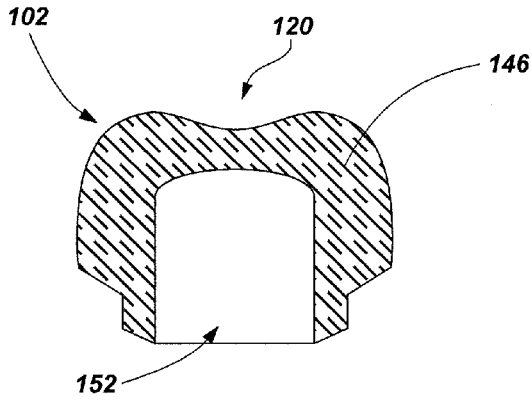

The partially shaped green body 118 shown in FIG. 3C may be at least partially sintered to provide a brown (partially sintered) body 120 shown in FIG. 3D, which has less than a desired final density. Partially sintering the green body 118 to form the brown body 120 may cause at least some of the plurality of particles to have at least partially grown together to provide at least partial bonding between adjacent particles. The brown body 120 may be machinable due to the remaining porosity therein. Certain structural features also may be machined in the brown body 120 using conventional machining techniques.

By way of example and not limitation, internal fluid passageways (e.g., the internal fluid passageways 30 and the longitudinal bore 34 (FIG. 2)) and cutting element pockets 22 (FIGS. 1 and 2) may be machined or otherwise formed in the brown body 120. The brown body 120 shown in FIG. 3D then may be fully sintered to a desired final density to provide the outer shell 146 of the bit body 102 which may be similar to the bit body 12 shown in FIGS. 1 and 2.

In other methods, the green body 116 shown in FIG. 3B may be partially sintered to form a brown body without prior machining, and all necessary machining may be performed on the brown body prior to fully sintering the brown body to a desired final density. Alternatively, all necessary machining may be performed on the green body 116 shown in FIG. 3B, which then may be fully sintered to a desired final density.

In some embodiments, the cavity 152 may be machined or otherwise formed in the green body 116 (FIG. 3B) or the brown body 120 (FIG. 3D).

The sintering process may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Furthermore, the sintering processes may include sub-liquidus phase sintering. In other words, the sintering processes may be conducted at temperatures proximate to but below the liquidus line of the phase diagram for the matrix material. For example, the sintering processes may be conducted using a number of different methods known to one of ordinary skill in the art, such as the Rapid Omnidirectional Compaction (ROC) process, the CERACON® process, hot isostatic pressing (HIP), or adaptations of such processes.

While the outer shell 46 of the bit body 12 has been described above with reference to FIGS. 3A through 3D (i.e., outer shell 146 and bit body 102) as being fabricated using powder compaction and sintering techniques, other fabrication processes may also be used. For example, the outer shell 46 of the bit body 12 may be fabricated using a layered-manufacturing process, such as those disclosed in U.S. Pat. No. 5,433,280, issued to Smith on Jul. 18, 1995, and in U.S. Pat. No. 5,544,550, issued to Smith on Aug. 13, 1996, both of which are assigned to the assignee of the present disclosure, and the entire disclosure of each of which is incorporated herein by this reference.

Briefly, a layered-manufacturing processes, includes methods of fabricating a earth-boring tool such as, for example, a bit body of a drill bit in a series of sequentially superimposed layers or slices. For example, a drill bit is designed as a three-dimensional "solid" model using a computer-aided design (CAD) program, which allows the designer to size, configure and place all internal and external features of the bit such as, for example, internal fluid passages and bit blank voids, and the rakes and locations of external cutting element pockets, as well as the height, thickness, profile and orientation of lands and ridges on the bit face, and the orientation, depth and profile of waterways on the bit face and junk slots on the bit gage. The CAD program then provides a solid model that is numerically "sliced" into a large number of thin, planar layers by known processes employing known computer programs.

The planar layers may then be formed from a granular or particulate material such as, for example, a tungsten carbide coated with a laser-reactive bonding agent. A finely focused laser, a focused light source such as from an incandescent or discharge type of lamp, or other energy beam, programmed to follow the configuration of the exposed section or layer of the bit body, is directed on the powder layer to melt the bonding agent and bond the metal particles together in the areas of the layer represented as solid portions of the bit in the model. Another layer of powder is then substantially uniformly deposited over the first, now-bonded layer, after which the metal particles of the second layer are bonded simultaneously to each other and to the first, or previously fabricated, layer by the laser. The process continues until all layers or slices of the bit, as represented by the solid model, have been deposited and bonded, resulting in a mass of bonded-particulate material comprising a bit body which substantially depicts the solid computer model.

In other embodiments, the outer shell 46 of the bit body 12 may be fabricated using a so-called "infiltration" process. In an infiltration process, an outer shell 46 of a bit body 12 may be fabricated using a graphite mold. Cavities of the graphite molds may be machined with a multi-axis machine tool. Fine features may then be added to the cavity of the graphite mold using hand-held tools. Additional clay work also may be required to obtain the desired configuration of some features of the bit body. Where necessary, preform elements or displacements (which may comprise ceramic components, graphite components, resin-coated sand compact components, etc.) may be positioned within the mold and used to define the internal passages, cutting element pockets 22, junk slots 28, and other external topographic features of the outer shell 46 of the bit body 12. The cavity of the graphite mold is filled with hard particulate carbide material (e.g., tungsten carbide, titanium carbide, tantalum carbide, etc.).

The mold then may be vibrated or the particles otherwise packed to decrease the amount of space between adjacent particles of the particulate carbide material. A matrix material (often referred to as a "mixture" material), such as a copper-based alloy, may be melted, and caused or allowed to infiltrate the particulate carbide material within the mold cavity. The mold and the outer shell 46 of the bit body 12 are allowed to cool to solidify the matrix material. Once the outer shell 46 of the bit body 12 has cooled, the outer shell 46 of the bit body 12 may be removed from the mold and any displacements are removed from the outer shell 46 of the bit body 12. Destruction of the graphite mold may be required to remove the outer shell 46 of the bit body 12 therefrom.

Figure 4:
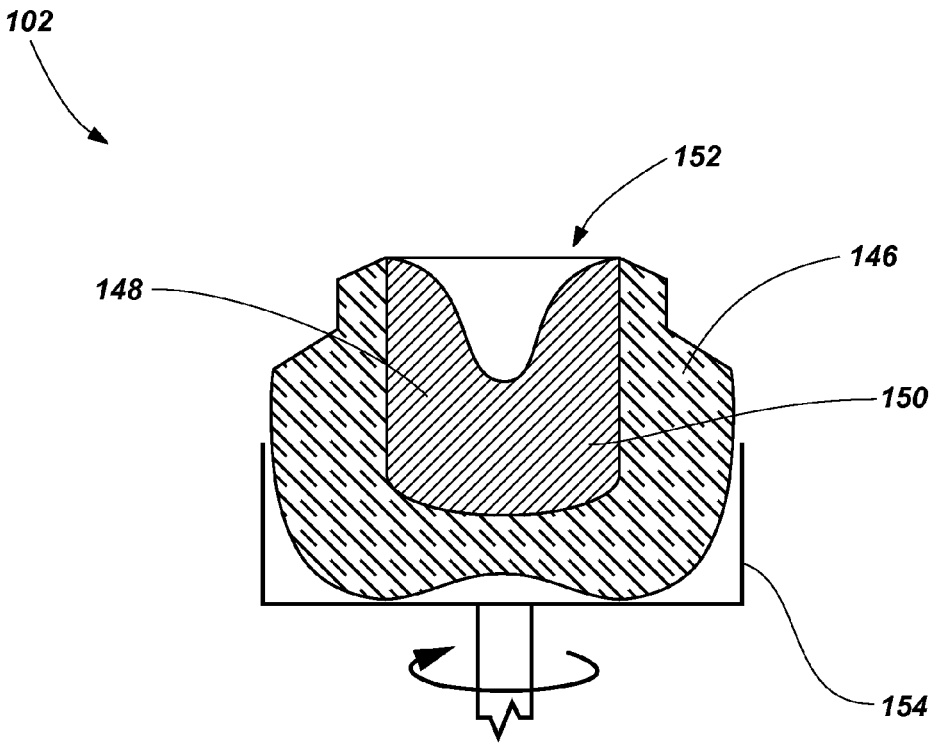
FIG. 4 shows a method of forming another portion of a bit body of an earth-boring rotary drill bit in accordance with embodiments of the present disclosure.

As shown in FIG. 4, a fabricated outer shell of a bit body (e.g., the outer shell 146 of bit body 102) may be used as a mold for fabricating an inner portion 148 of the bit body 102. For example, a molten material 150 (e.g., a liquid or liquid slurry) may be cast into a cavity 152 formed in the outer shell 146 of the bit body 102 to form the inner portion 148 of the bit body 102. As used herein, the term "molten material" may refer to a composition that has been heated (e.g., at least partially melted) in order to be used in a casting or other fabrication process and may also refer to the composition after it has at least partially or fully solidified (i.e., solidified molten material). In some embodiments, the molten material 150 may comprise a mixture such as, for example, the compositions disclosed in U.S. patent application Ser. No. 10/848,437, filed May 18, 2004, abandoned, which is assigned to the assignee of the present disclosure, and the entire disclosure of which is incorporated herein by this reference.

In some embodiments, the mixture of the molten material 150 may be selected to have a melting temperature between 1050° C. and 1350° C. In other embodiments, the mixture may comprise an alloy of at least one of cobalt, iron, and nickel, wherein the alloy has a melting point of less than 1350° C. In some embodiments, the mixture may comprise at least one of cobalt, nickel, and iron and a melting point-reducing constituent. The melting point-reducing constituent may be at least one of a transition metal carbide, a transition element, tungsten, carbon, boron, silicon, chromium, manganese, silver, aluminum, copper, tin, zinc, as well as other elements that alone or in combination can be added in amounts that reduce the melting point of the mixture. In some embodiments, two or more of the above melting point-reducing constituents may be combined. For example, tungsten and carbon may be added together to produce a greater melting point reduction than may be produced by the addition of tungsten alone and, in such a case, the tungsten and carbon may be added in the form of tungsten carbide. Other melting point-reducing constituents may be added in a similar manner.

In some embodiments, the one or more melting point-reducing constituents may be added to a metal or a metal alloy such that the mixture is a eutectic or near eutectic composition (e.g., a substantially eutectic composition). A mixture with a eutectic or near-eutectic concentration of constituents may provide composition that will have a lower melting point. For example, a eutectic or near eutectic composition may provide a composition having a lower melting point required to form a molten material 150, which may facilitate casting of the molten material 150. In other words, the molten material 150 may be formed from a eutectic or near-eutectic concentration of constituents that may solidify and melt at approximately a single lower temperature than a different, non-eutectic mixture of the same constituents.

Such a eutectic or near-eutectic mixture may comprise a metal (e.g., cobalt, nickel, iron, cobalt alloys, nickel alloys, iron alloys, etc.) and a carbide (e.g., tungsten carbide). For example, a eutectic or near-eutectic mixture may include cobalt-tungsten carbide, nickel-tungsten carbide, cobalt-nickel-tungsten carbide, and iron-tungsten carbide alloys. In some embodiments, the molten material 150 may be formed by a cobalt-tungsten carbide eutectic or near eutectic composition include constituents having 30 to 60% tungsten carbide and 40 to 70% cobalt, by weight. Use of a eutectic or near-eutectic mixture may provide a molten material 150 having a melting point that is relatively lower than a composition including only a metal (e.g., cobalt, iron, nickel, etc.). For example, a cobalt alloy having a concentration of approximately 43 weight % of tungsten carbide has a melting point of approximately 1300° C. which is less than the melting point of cobalt alone which is approximately 1500° C.

In some embodiments, the one or more melting point-reducing constituents may be added to a metal or a metal alloy such that the mixture is a hypoeutectic composition. As above, a mixture with a hypoeutectic concentration of constituents may provide composition that will have a lower melting point required to form the molten material 150, which may facilitate casting of the molten material 150. However, a hypoeutectic composition may have a relatively lower concentration of the one or more melting point-reducing constituents than a concentration of the one or more melting point-reducing constituents in a eutectic or near eutectic composition.

In some embodiments, the one or more melting point-reducing constituents may be present in the mixture in the following weight percentages based on the total mixture weight: tungsten may be present up to 55%, carbon may be present up to 4%, boron may be present up to 10%, silicon may be present up to 20%, chromium may be present up to 20%, and manganese may be present up to 25%. In other embodiments, the one or more melting point-reducing constituents may be present in the mixture in one or more of the following weight percentage based on the total mixture weight: tungsten may be present from 30 to 55%, carbon may be present from 1.5 to 4%, boron may be present from 1 to 10%, silicon may be present from 2 to 20%, chromium may be present from 2 to 20%, and manganese may be present from 10 to 25%. In yet other embodiments, the melting point-reducing constituent may be tungsten carbide present from 30 to 60 weight %. Under certain casting conditions and mixture concentrations, all or a portion of the tungsten carbide will precipitate from the mixture upon freezing and will form a hard phase. This precipitated hard phase may be in addition to any hard phase present as hard particles in the mold formed by the outer shell 146.

Referring still to FIG. 4, in some embodiments, the molten material 150 may be disposed within the outer shell 146 of the bit body 102 while the outer shell 146 is being rotated on a support 154. By rotating the outer shell 146 of the bit body 102 the molten material 150 may be centrifugally cast within the outer shell 146 to form the inner region 148. Such centrifugal casting may enable a directional solidification from the outer diameter to the inner diameter of the inner region 148 to produce a consistent grain structure having enhanced strength and toughness properties. Further, under the centrifugal force, inclusions and gas porosity in the molten material 150 will migrate to an interior bore formed in the inner region 148 by the centrifugal force and may be removed (e.g., by machining). It is noted that while the embodiment described with reference to FIG. 4 illustrates the molten material 150 as being centrifugally cast within the outer shell 146, in other embodiments, the molten material 150 may also be cast into the outer shell 146 while the outer shell 146 is stationary.

In some embodiments, inserts or displacement members similar to displacement members 108, described above with reference to FIG. 3A, may be provided within the inner region 148 of the bit body 102 for defining features of the bit body 102 such as, for example, the internal fluid passageways (e.g., a longitudinal bore 134 (FIG. 5)). In some embodiments, an additional mold may be placed on the proximal portion of the outer shell 146 to form a protrusion in the bit body 102 that may be used to connect to an extension 18 or a shank 14 as described in the aforementioned and incorporated by reference U.S. patent application Ser. No. 11/271,153 now U.S. pat. No. 7,802,495, issued Sep. 28,2010, and U.S. patent application Ser. No. 11/272,439, now U.S. pat. No. 7,776,256, issued Aug. 17,2010.

Figure 5:
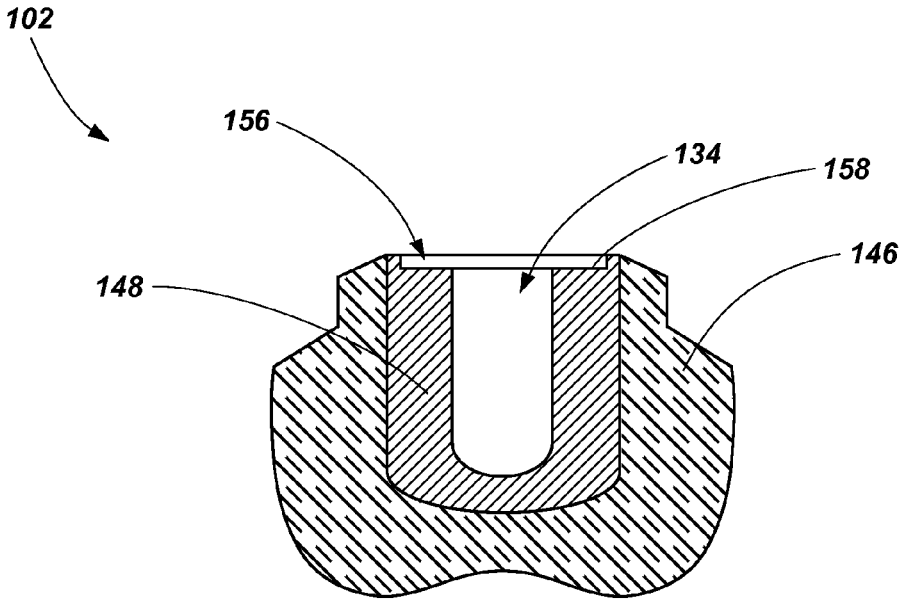
FIG. 5 shows a cross-sectional view of a bit body formed by the method illustrated in FIG. 4.

FIG. 5 shows a cross-sectional view of the bit body 102 after the molten material 150 has solidified to form the inner region 148 within the outer shell 146. In some embodiments, after the molten material 150 has solidified to form the inner region 148 of the bit body 102, structural features may be machined in the inner region 148 using conventional machining techniques including, for example, turning techniques, milling techniques, and drilling techniques. Hand held tools also may be used to manually form or shape features in or on the inner region 148. For example, a longitudinal bore 134 may be formed in the inner region 148. In some embodiments, a cavity 156 may be formed in the surface 158 of the inner region 148 that is configured for attachment of the bit body 102 to the extension 18 or shank 14 (FIG. 2). In some embodiments, the inner region 148 may be selected to have a material composition that is chemically or metallurgically compatible with a material composition of the extension 18 or shank 14 (FIG. 2) such that the extension 18 or shank 14 can be successfully attached (e.g., welded, brazed, or a combination of welding and brazing) to the inner region 148 of the bit body 102 without the formation of detrimental phases of material (e.g., brittle phases) near the boundary between the bit body 102 and the extension 18 or shank 14 upon bonding the extension 18 or shank 14 to the bit body 102.

In some embodiments, the outer shell 146 may be selected to include a material composition that exhibits enhanced abrasion-resistance and erosion-resistance properties. Such properties may be desirable as the outer shell 146 is dragged along a surface of a subterranean wellbore filled with drilling fluid in order to drill the wellbore into a subterranean formation. In some embodiments, the inner region 148 may be selected to include a material composition that exhibits enhanced erosion-resistance properties. Such properties may be desirable as the longitudinal bore 134 is formed in the inner region 148. The longitudinal bore 134 may act as a passage for drilling fluid through the bit body 102 to access internal fluid passageways formed in the bit body 102 (e.g., internal fluid passageways 30 formed in bit body 12).

Figure 6:
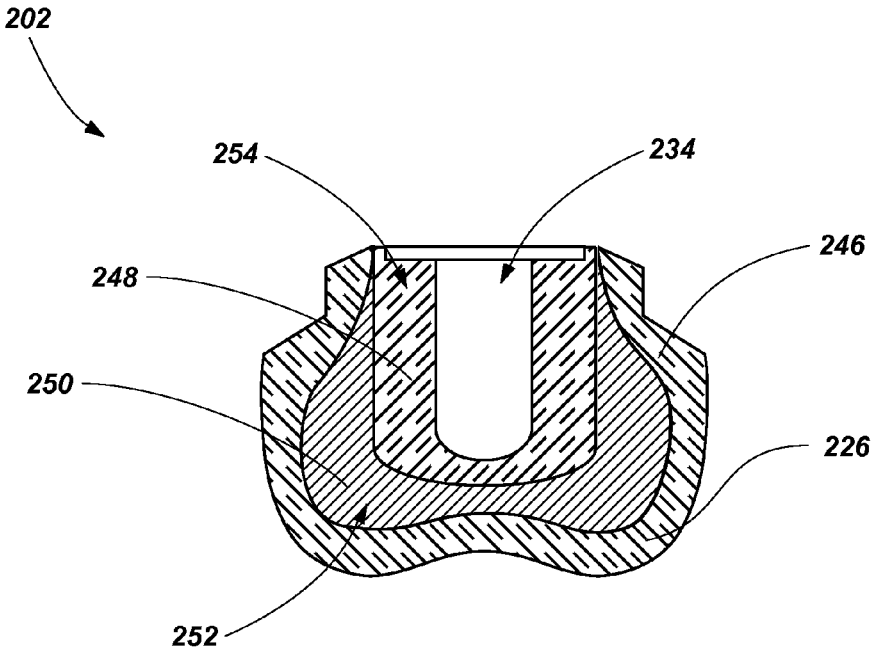
FIG. 6 shows a cross-sectional view of another bit body formed in accordance with embodiments of the present disclosure.

FIG. 6 shows a cross-sectional view of a bit body 202 that may be formed using a method similar to the methods described above with reference to FIGS. 3A through 5. However, bit body 202 may be formed with additional regions or layers within an outer shell 246. For example, bit body 202 may include a first inner region 248 and a second inner region 250. The second inner region 250 may be formed in a cavity 252 in the outer shell 246 and the first inner region 248 may be formed in a cavity 254 formed in the second inner region 250. It is noted that while the embodiment of FIG. 6 illustrates a bit body 202 having three regions, bit bodies or other earth-boring tools may be formed with as many regions or layers as desirable.

As shown in FIG. 6, the bit body 202 may include an outer shell 246 and a first inner region 248 that may be similar to the outer shell 146 and the inner region 148 described above with reference to FIG. 5. In some embodiments, the outer shell 246 may be selected to include a material composition that exhibits enhanced abrasion-resistance and erosion-resistance properties. In some embodiments, the inner region 248 may include a material composition that is chemically or metallurgically compatible with a material composition of the extension 18 or shank 14 (FIG. 2) and material properties that exhibit enhanced erosion-resistance properties. The bit body 202 may also include a second inner region 250 formed between the outer shell 246 and the first inner region 248. A portion of the second inner region 250 may extend outwardly from the first inner region 248 toward the outer shell 246 and into blades 226 of the bit body 202. Stated in another way, the second inner region 250 may extend within the bit body 202 proximate to an outer surface of the blades 226 (e.g., to a portion within the bit body 202 in a radial location between the junk slots 28 and the blades 26 (FIG. 1)). In some embodiments, the second inner region 250 may be selected to include a material composition that exhibits enhanced toughness and crack resistance. Such properties may be desirable as the blades 26 having cutting elements 20 disposed thereon (shown in FIG. 1) are subjected to relatively large forces and stresses during a drilling operation as the blades 26 and cutting elements 20 are dragged along a surface of a subterranean wellbore in order to drill the wellbore into a subterranean formation. In some embodiments, after the second inner region 250 has been formed, the cavity 254 may be machined or otherwise formed in the second inner region 250.

Figure 7:
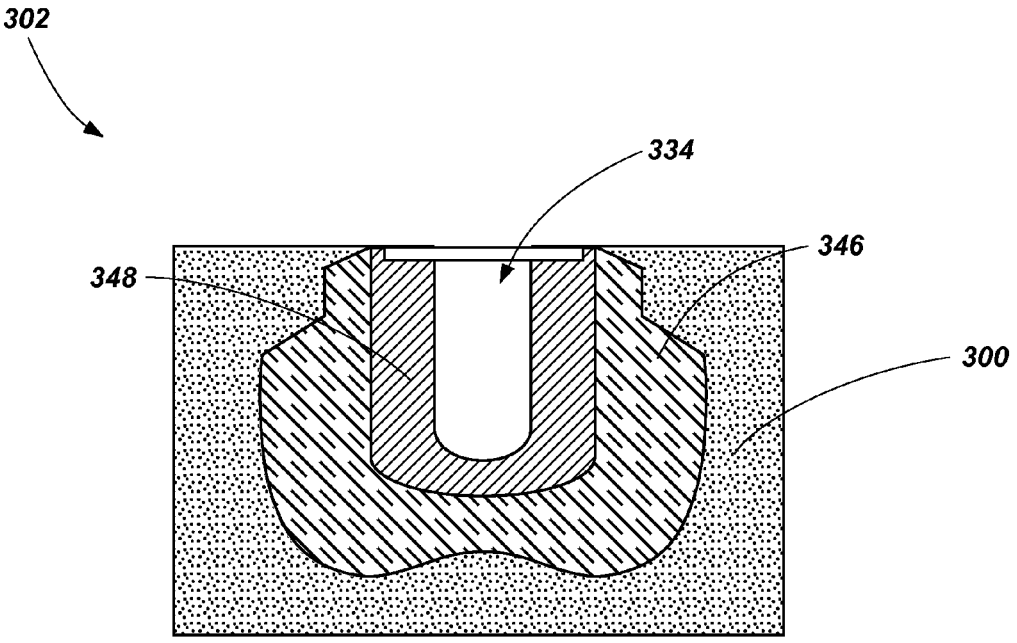
FIG. 7 shows a method of forming a bit body of an earth-boring rotary drill bit in accordance with embodiments of the present disclosure.

FIG. 7 shows a cross-sectional view of a bit body 302 that may be formed using a method similar to the methods described above with reference to FIGS. 4 through 6. However, an outer shell 346 and inner region 348 of the bit body 302 may be formed by casting within a ceramic mold 300. The bit body 302 may be formed by rotating the mold 300 and disposing a molten material similar to the molten material 150 described above with reference to FIG. 4 to form the outer shell 346. After forming the outer shell 346, the solidified molten material may be machined to the desired shape and another molten materiel may be disposed within the mold 300 and the outer shell 346 to form the inner region 348. Structural features (e.g., a longitudinal bore 334) may be machined in the inner region 348. The mold 300 may be removed (e.g., by destroying the mold 300) from the bit body 302 after forming the outer shell 346.

Figure 8:
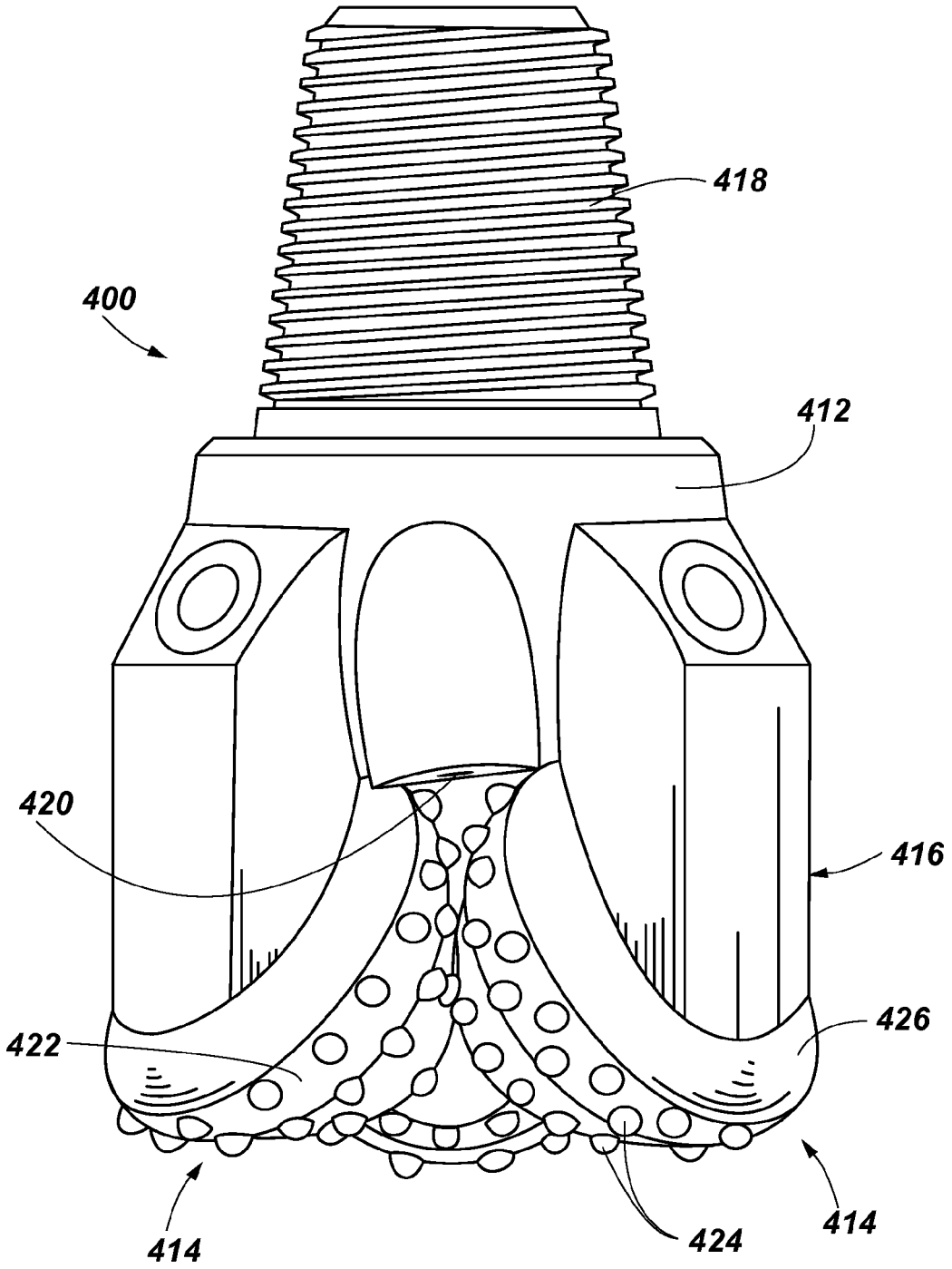
FIG. 8 is a perspective view of a roller cone bit having rotatable cutter assemblies formed in accordance with embodiments of the present disclosure.

As shown in FIG. 8, the methods described above may also be used to form components of a roller cone bit 400. In some embodiments, the roller cone bit 400 may be similar to the roller cone bit disclosed in U.S. patent application Ser. No. 11/710,091, filed Feb. 23, 2007, abandoned, which is assigned to the assignee of the present disclosure, and the entire disclosure of which is incorporated herein by this reference. The roller cone bit 400 includes a bit body 412 and a plurality of rotatable cutter assemblies 414. The bit body 412 may include a plurality of integrally formed bit legs 416, and threads 418 may be formed on the upper end of the bit body 412 for connection to a drill string (not shown). The bit body 412 may have nozzles 420 for discharging drilling fluid into a borehole, which may be returned along with cuttings up to the surface during a drilling operation. Each of the rotatable cutter assemblies 414 include a cone 422 comprising a particle-matrix composite material and a plurality of cutting elements, such as the cutting inserts 424 shown. Each cone 422 may include a conical gage surface 426. Additionally, each cone 422 may have a unique configuration of cutting inserts 424 or cutting elements, such that the cones 422 may rotate in close proximity to one another without mechanical interference.

Figure 9:
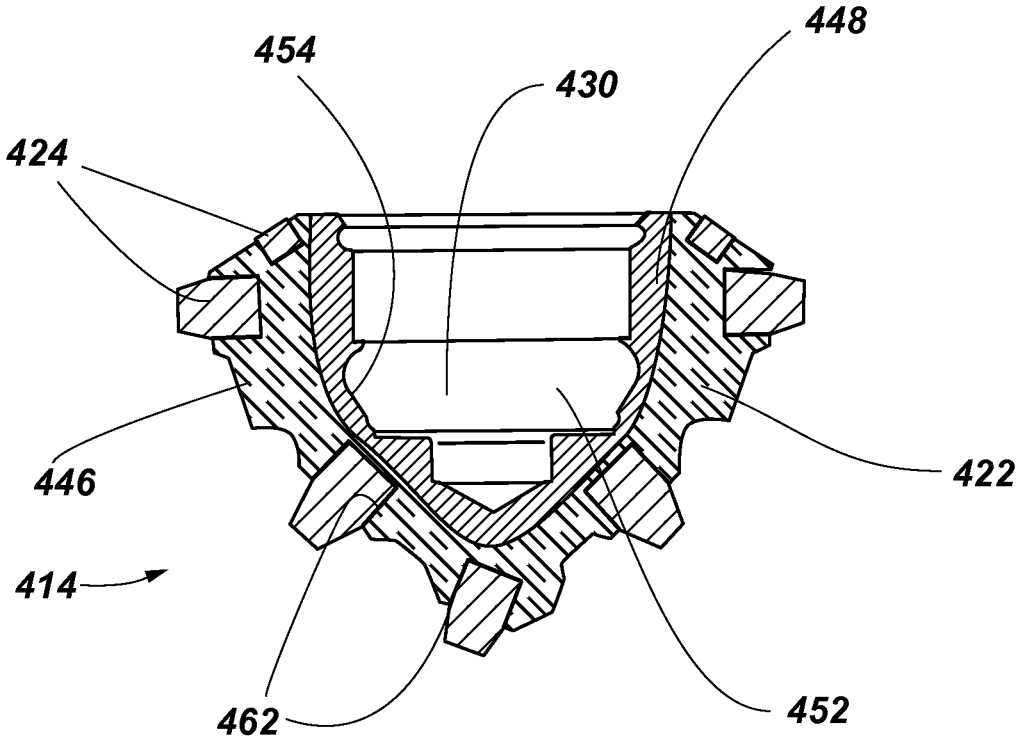
FIG. 9 shows an enlarged cross-sectional view of a rotatable cutter assembly formed in accordance with embodiments of the present disclosure.

As shown in FIG. 9, a rotatable cutter assembly 414 may include cutting inserts 424 secured within apertures 462. The rotatable cutter assembly 414 may include an outer shell 446 having a first material composition and an inner region 448 having a second, different material composition. The rotatable cutter assembly 414 may be formed using a method similar to the methods described above with reference to FIGS. 3A through 7. For example, the outer shell 446 may be formed by a press and sintering process and the inner region 448 may be formed by rotating the outer shell 446 and disposing a molten material (similar to the molten material described above with reference to FIG. 4) in the outer shell 446 to form the inner region 448. An inner mold 452 may also be used to form the shape of a central cavity 430 and a journal bearing surface 454 that is mounted adjacent to the bearing pin (not shown) enabling the rotatable cutter assembly 414 to rotate about the bearing pin. In some embodiments, the inner region 448 may be selected to have a material composition having wear resistant properties that enable the inner region 448 to rotate about and contact the bearing pin while increasing the wear life of the rotatable cutter assembly 414.

Although embodiments of methods of the present disclosure have been described hereinabove with reference to bit bodies of earth-boring rotary drill bits and rotatable cutter assembly of roller cone bits, the methods of the present disclosure may be used to form bodies of earth-boring tools and components thereof other than fixed-cutter rotary drill bits and roller cone bits including, for example, other components of fixed-cutter rotary drill bits and roller cone bits, impregnated diamond bits, core bits, eccentric bits, bicenter bits, reamers, mills, and other such tools and structures known in the art.

Embodiments of the present disclosures may be particularly useful in forming an earth-boring tool having a variation of customized material properties in the earth-boring tool. For example, components of earth-boring tools that are used to form a subterranean wellbore may have enhanced abrasion-resistance properties, enhanced toughness properties, enhanced crack resistance properties or combinations thereof. Components of earth-boring tools that are exposed to drilling fluid may have enhanced erosion-resistance properties. Components of earth-boring tools that are used to attach a first portion of the tool having a first material composition to a second portion of the tool having a second, differing material composition may have material properties that are chemically or metallurgically compatible with material compositions of each portion of the tool.

While the present disclosure has been described herein with respect to certain embodiments, those of ordinary skill in the art will recognize and appreciate that it is not so limited. Rather, many additions, deletions and modifications to the described embodiments may be made without departing from the scope of the disclosure as hereinafter claimed, including legal equivalents. In addition, features from one embodiment may be combined with features of another embodiment while still being encompassed within the scope of the disclosure as contemplated by the inventors.

What is claimed is:

1. A method of fabricating an earth-boring tool, comprising:

forming a solidified outer portion of an earth-boring tool from a powder mixture comprising hard particles and matrix particles comprising a metal matrix material; and after forming the solidified outer ortion of the earth-boring tool from the powder mixture, disposing a molten material at least partially within the outer portion of the earth-boring tool to form another portion of the earth-boring tool, wherein the another portion of the earth-boring tool is positioned at least partially within the solidified outer portion of the earth-boring tool.

2. The method of claim 1, wherein disposing a molten material at least partially within the outer portion of the earth-boring tool comprises disposing the molten material at least partially within the outer portion of the earth-boring tool while rotating the outer portion of the earth-boring tool and selecting the molten material to comprise a material that will remain substantially within the outer portion of the earth-boring tool during the formation of the inner portion of the earth-boring tool.

3. The method of claim 1, wherein disposing a molten material at least partially within the outer portion of the earth-boring tool comprises selecting at least one material of the molten material to exhibit at least one of an enhanced erosion-resistance property and a material composition that is chemically or metallurgically compatible with at least one of the hard particles and the matrix particles of the outer portion of the earth-boring tool.

4. The method of claim 1, further comprising:

disposing a second molten material at least partially within the another portion of the earth-boring tool; and forming the second molten material into an additional portion of the earth-boring tool disposed within the another portion of the earth-boring tool.

5. The method of claim 4, wherein disposing a molten material at least partially within the outer portion of the earth-boring tool comprises selecting at least one material of the molten material to exhibit enhanced toughness and crack resistance and wherein disposing a second molten material at least partially within the another portion of the earth-boring tool comprises selecting at least one material of the second molten material to exhibit at least one of an enhanced erosion-resistance property and a material composition that is chemically or metallurgically compatible with another portion of the earth-boring tool.

6. The method of claim 1, wherein forming the outer portion of the earth-boring tool comprises:

applying pressure to the powder mixture within a mold cavity to form a green body; and sintering the green body to form the outer portion of the earth-boring tool.

7. The method of claim 6, further comprising removing the outer portion of the earth-boring tool from the mold cavity before disposing the molten material at least partially within the outer portion of the earth-boring tool.

8. The method of claim 1, further comprising selecting the hard particles to comprise a material selected from the group consisting of diamond, boron carbide, boron nitride, aluminum nitride, silicon nitride, and carbides or borides of W, Ti, Mo, Nb, V, Hf, Zr, Si, Ta, and Cr.

9. The method of claim 8, further comprising selecting the matrix particles to comprise a metal selected from the group consisting of iron, nickel, cobalt, titanium, aluminum, copper-based alloys, iron-based alloys, nickel-based alloys, cobalt-based alloys, titanium-based alloys, and aluminum-based alloys.

10. The method of claim 1, wherein disposing a molten material at least partially within the outer portion of the earth-boring tool comprises disposing at least one of a substantially eutectic composition and a substantially hypoeutectic composition comprising tungsten carbide and at least one of cobalt, iron, and nickel at least partially within the outer portion of the earth-boring tool.

11. The method of claim 1, further comprising forming the earth-boring tool to comprise an earth-boring drill bit comprising a plurality of blades.

12. The method of claim 1, further comprising forming the earth-boring tool to comprise at least one rotatable cutter assembly of a roller cone bit.

13. A method of fabricating a bit body of an earth-boring rotary drill bit, comprising:

forming an outer portion of a bit body comprising a plurality of hard particles and a plurality of matrix particles comprising a metal matrix material;

sintering the outer portion of the bit body to form an at least substantially fully dense outer portion of a bit body of an earth-boring rotary drill bit; and casting a molten material at least partially within the at least substantially fully dense outer portion of the bit body to form another portion of the bit body at least partially within the outer portion of the bit body.

14. The method of claim 13, wherein casting a molten material at least partially within the at least substantially fully dense outer portion of the bit body to form another portion of the bit body comprises casting at least one of a substantially eutectic composition and a substantially hypoeutectic composition comprising tungsten carbide and at least one of cobalt, iron, and nickel.

15. The method of claim 13, wherein casting a molten material at least partially within the at least substantially fully dense outer portion of the bit body to form another portion of the bit body comprises casting the molten material while rotating the at least substantially fully dense outer portion of the bit body.

16. The method of claim 13, further comprising:

disposing a second molten material at least partially within the another portion of the bit body; and forming the second molten material into an additional portion of the bit body.

17. The method of claim 16, further comprising selecting at least one material of the molten material to exhibit enhanced toughness and crack resistance.

18. The method of claim 16, further comprising selecting at least one material of the second molten material to exhibit at least one of an enhanced erosion-resistance property and a material composition that is chemically or metallurgically compatible with another portion of the earth-boring drill bit.

19. A method of fabricating an earth-boring tool, comprising:

forming a solidified outer portion of an earth-boring tool from a powder mixture comprising hard particles and matrix particles comprising a metal matrix material; and after forming the solidified outer portion of the earth-boring tool from the powder mixture, casting a molten material at least partially within the outer portion of the earth-boring tool to form an inner portion of the earth-boring tool separate from the outer portion of the earth-boring tool formed from the powder mixture.

* * * * *

UNITED STATES PATENT AND TRADEMARK OFFICE

CERTIFICATE OF CORRECTION

PATENT NO. : 8,881,791 B2
APPLICATION NO. : 13/087204
DATED : November 11, 2014
INVENTOR(S) : Jimmy W. Eason and Michael R. Wells It is certified that error appears in the above-identified patent and that said Letters Patent is hereby corrected as shown below:

In the specification:

| | | |
|---|---|---|
| COLUMN 4, | LINE 7, | change "17,2010," to --17, 2010,-- |
| COLUMN 4, | LINE 8, | change "pending U.S." to --U.S.-- |
| COLUMN 5, | LINE 11, | change "17,2010." to --17, 2010.-- |
| COLUMN 8, | LINE 28, | change "(e.g., the" to --(e.g., an-- |
| COLUMN 10, | LINE 27, | change "28,2010," to --28, 2010,-- |
| COLUMN 10, | LINE 29, | change "17,2010." to --17, 2010.-- |
| COLUMN 12, | LINE 11, | change "such as the" to --such as-- |

Signed and Sealed this
Twentieth Day of October, 2015

Michelle K. Lee

Michelle K. Lee
*Director of the United States Patent and Trademark Office*